US007329166B2

(12) United States Patent
Hatting et al.

(10) Patent No.: US 7,329,166 B2
(45) Date of Patent: Feb. 12, 2008

(54) AUTOMOTIVE TOY COMPRISING FLEXIBLE ELEMENTS

(75) Inventors: Jan Hatting, Vejle (DK); Olav Krøigaard, Bredsten (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 10/491,682

(22) PCT Filed: Oct. 7, 2002

(86) PCT No.: PCT/DK02/00668

§ 371 (c)(1),
(2), (4) Date: Apr. 2, 2004

(87) PCT Pub. No.: WO03/031007

PCT Pub. Date: Apr. 17, 2003

(65) Prior Publication Data

US 2004/0248500 A1 Dec. 9, 2004

(30) Foreign Application Priority Data

Oct. 9, 2001 (PA) ..... 2001 01487

(51) Int. Cl.
*A63H 17/00* (2006.01)

(52) U.S. Cl. ..... 446/93; 446/122; 446/465

(58) Field of Classification Search ..... 446/85, 446/90, 91, 93–96, 454, 465, 470, 484, 127, 446/128, 434, 154, 88, 471, 456, 120, 122, 446/123, 124, 125, 460, 469; 403/150, 157, 403/286, 292, 294, 295
See application file for complete search history.

(56) References Cited

U.S. PATENT DOCUMENTS

| | | | | | |
|---|---|---|---|---|---|
| 1,815,708 | A | * | 7/1931 | Gilbert | 446/90 |
| 2,044,735 | A | * | 6/1936 | Pelton | 446/90 |
| 2,744,590 | A | * | 5/1956 | Butts | 52/645 |
| 2,772,441 | A | * | 12/1956 | Riser | 16/276 |
| 3,224,135 | A | * | 12/1965 | Wright et al. | 446/95 |
| 3,224,137 | A | * | 12/1965 | Wright et al. | 446/94 |
| 4,109,398 | A | * | 8/1978 | Hida | 434/370 |
| 4,214,402 | A | * | 7/1980 | Ogawa | 446/90 |
| 4,224,762 | A | * | 9/1980 | McCaslin | 446/456 |
| 4,548,584 | A | * | 10/1985 | Townsend | 434/118 |
| 4,697,133 | A | * | 9/1987 | Pergandis | 320/107 |
| 4,712,184 | A | * | 12/1987 | Haugerud | 701/1 |
| 4,764,150 | A | | 8/1988 | Uchino | 446/456 |

(Continued)

FOREIGN PATENT DOCUMENTS

| | | |
|---|---|---|
| DK | 5261/87 | 7/1987 |

(Continued)

*Primary Examiner*—Monica Carter
*Assistant Examiner*—Jamila Williams
(74) *Attorney, Agent, or Firm*—Day Pitney LLP

(57) ABSTRACT

An automotive toy (1) constructed from a number of toy building elements, of which a plurality are configured as functionality modules (2, 3, 4, 5), each of which being configured with technical means for performing a specific functionality in the automotive toy (1). In the automotive toy at least one flexible toy building element (18) is provided that is located between two functionality modules (2, 3, 4, 5), whereby this flexible toy building element (18) is caused to form a flexible interconnection between the functionality modules (2, 3, 4, 5).

14 Claims, 2 Drawing Sheets

U.S. PATENT DOCUMENTS

| | | | | |
|---|---|---|---|---|
| 4,813,903 | A * | 3/1989 | Furukawa et al. | 446/90 |
| 4,813,906 | A | 3/1989 | Matsuyama et al. | 446/457 |
| 4,861,306 | A * | 8/1989 | Bolli et al. | 446/90 |
| 4,940,442 | A * | 7/1990 | Matsuda | 446/90 |
| 4,993,983 | A * | 2/1991 | Kurita et al. | 446/94 |
| 5,411,428 | A * | 5/1995 | Orii et al. | 446/90 |
| 5,752,871 | A | 5/1998 | Tsuzuki | 446/457 |
| 6,234,866 | B1 | 5/2001 | Ben-Yakar et al. | 446/431 |
| 6,585,553 | B1 * | 7/2003 | Fetridge et al. | 446/91 |
| 2003/0040250 | A1 * | 2/2003 | Yim et al. | 446/91 |

FOREIGN PATENT DOCUMENTS

| | | | |
|---|---|---|---|
| EP | 58126 | A * | 8/1982 |
| EP | 357158 | A1 * | 3/1990 |
| GB | 2000219 | A * | 1/1979 |
| JP | S48-018293 | | 3/1973 |
| JP | S62-088203 | | 6/1987 |
| JP | 3005197 | | 12/1994 |
| JP | 10-137452 | | 10/1998 |

* cited by examiner

AUTOMOTIVE TOY COMPRISING FLEXIBLE ELEMENTS

The invention relates to an automotive toy constructed from a number of toy building elements, of which a plurality are configured as functionality modules, each of which being configured with technical means for performing a specific functionality in relation to the automotive toy.

Such automotive toy comprising functionality modules that can be interconnected to form a remote-controlled toy car is known. The functionality modules in this prior art automotive toy comprise ia a motor unit, a battery unit, a steering unit and a radio receiver unit. These various functionality modules are interconnected and arranged in an outer chassis frame and in this manner, it forms a remote-controlled toy car.

A toy car of this type has a completely rigid structure, which means that there is a high risk of the chassis frame or the functionality modules being damaged in case the toy car is exposed to impacts or blows. Such impacts or blows may occur in case of rough playing with the toy car and may follow from the car driving into an obstacle, falls from high above, or in case the child who plays with the car for instance steps on it. The risk of such damage is particularly high if the toy car is used outdoors where the support is often very uneven and where the playing is often more rough than in case of indoors playing.

It is the object of the invention to provide an automotive toy of the kind described above, whereby the risk of the damaging said automotive toy is minimized even when it is exposed to rough playing.

This is obtained by configuring the automotive toy featured above such that at least one flexible toy building element made of a soft plastic or rubber material is provided, said flexible toy building element being located between two functionality modules, such that this flexible toy building element forms a flexible interconnection between the functionality modules.

Hereby it is obtained that a certain flexing may occur between the functionality modules if the automotive toy is exposed to an external impact. In this manner, the flexible toy building element absorbs a part of the external impact and therefore there is a reduced risk of the functionality modules or their coupling means being damaged.

It is to be pointed out that the term 'automotive toy' as used in the present description is intended to designate both vessels as such and toy cars, toy boats, toy planes as well as other toys provided with movable parts, such as robots, dolls, machines, etc. The automotive toys may thus be configured for use on or in the ground, on or in the water or in the air.

According to a preferred embodiment the functionality modules comprise a motor module and a battery module. By use of such modules it is possible to compose various motor-operated automotive toys, and the automotive toy being self-powered the risk of it colliding with obstacles before the child or the person who plays with the automotive toy succeeds in stopping it is increased considerably.

According to a particularly preferred embodiment the functionality modules further comprise a radio-signal receiver module and a remote-control unit provided with a radio transmitter. Hereby the automotive toy becomes remote-controlled, which further contributes to the risk of it colliding with obstacles.

If the automotive toy is configured as a toy car the functionality modules further comprise a steering module, whereas a combined motor and steering module is provided if the automotive toy is configured for instance as a toy boat.

In order to minimize the risk of damaging the functionality modules, flexible toy building elements are preferably provided between all the functionality modules.

Preferably the functionality modules are provided with protruding elements with transversal openings, and the flexible toy building element is provided with second protruding elements with transversal openings, which second protruding elements are complementary with the protruding elements on the functionality modules. Hereby the functionality modules and the flexible toy building element can be interconnected by means of pins that extend through the transversal openings in the protruding parts of both the functionality modules and the flexible toy building element. Such configuration of the coupling means yields a solid and strong interconnection that effectively prevents the toy building elements from being separated unintentionally.

According to a particularly preferred embodiment of the coupling means, each of the pins is provided with a snap-engagement bead, whereas the protruding elements on the functionality modules are configured with a counterboring at the transversal openings for receiving the snap-engagement bead of the pin, and to facilitate mounting and dismounting of the pin it may be provided with a grip at the one end.

The invention will now be explained in further detail with reference to the drawing, wherein FIG. 1 shows an automotive toy according to the invention in a first embodiment;

Figure 1:
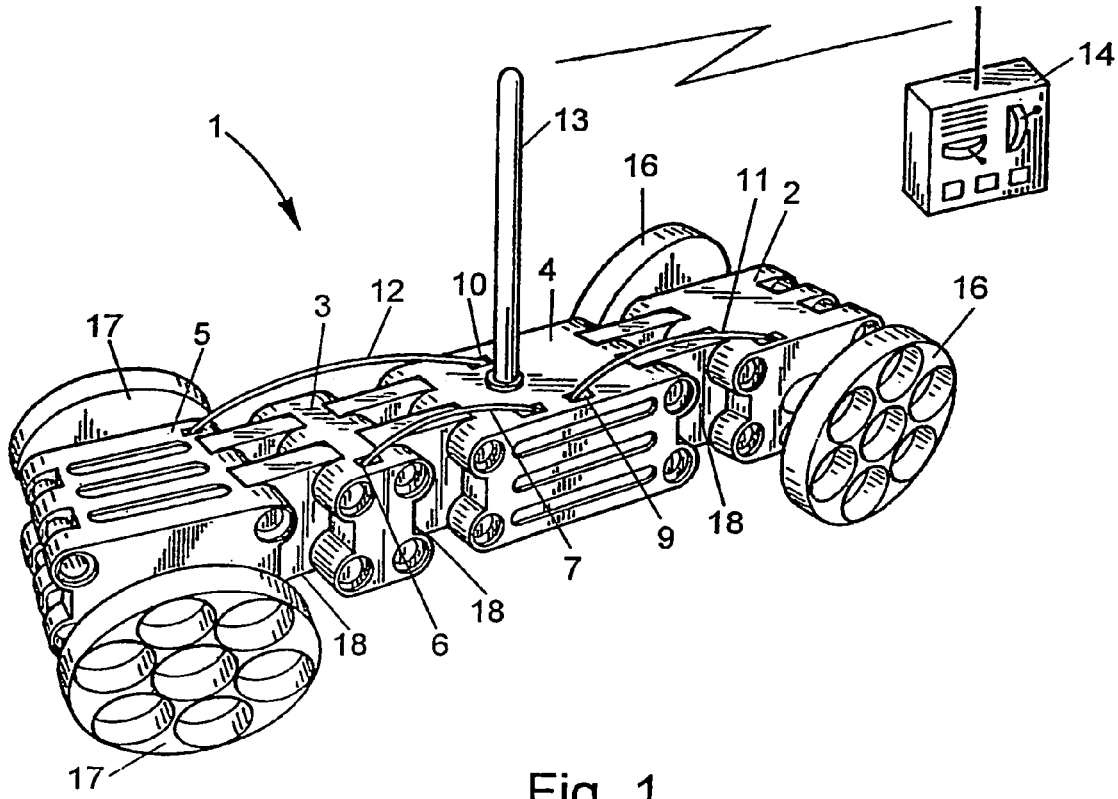

FIG. 1 shows an automotive toy according to the invention in a first embodiment, in which it is configured as a radio-controlled toy car 1. The toy car 1 comprises a number of functionality modules that consist, in the embodiment shown, of a motor module 2, a battery module 3, a radio-signal receiver module 4 and a steering module 5. Each of these functionality modules consists of a closed unit with outlets for the mechanical and/or electrical connections that this particular functionality module possesses in order to be able to perform a specific functionality in the toy car 1. The term 'functionality module' as used in connection with the present invention is intended to designate a unit that is provided with mechanical coupling means for interconnection with other toy building elements to construct the automotive toy. In addition to mechanical coupling means for interconnection with other toy building elements the functionality module is configured with mechanical and/or electronic means that enable it to perform a specific functionality in the automotive toy.

The battery module 3 that comprises one or more batteries of common type is thus provided with an outlet 6 for a cord 7 that is coupled to a switch 8 in the radio-receiver module 4 and via this cord the module is powered with current.

The radio-receiver module 4 is provided with further switches 9,10 to which cords 11,12 are connected that are in connection with the motor module 2 and the steering module 5, respectively. These cords 11,12 not only supply current to the motor module 2 and the steering module 5, but they also transmit signals for controlling the integral mechanical and/or electronic functionalities within these modules. The radio-receiver module 4 is also provided with a receiver antenna 13 that is able to receive radio signals from a remote controller 14 that may be of any known type and which will subsequently not be subject to closer description herein.

The motor module 2 has an integral electromotor (not shown) and the control signals that are transmitted from the radio-receiver module 4 to the motor module 2 via the cord 11 contains information about the operation of this motor, which is—via a drive shaft 15 (cf FIG. 3)—connected to two wheels 16, optionally via a differential provided integrally in the motor module 2.

In the same manner the steering module 5 is provided with an integral electromotor (not shown) that receives control signals from the radio-receiver module 4 via the cord 12. These signals activate the motor to rotate the wheels 17 to the right or the left via a steering device that is not described in further detail.

The functionalities just described of a remote-controlled toy car are known essentially from the toy car described in the introductory part.

The remote-controlled toy car 1 shown in FIG. 1 is, as opposed to the prior art toy cars, configured with flexible toy building elements 18 between the functionality modules. In this manner flexibility is obtained between the individual functionality modules, such as between the motor module 2 and the radio-receiver module 4, between the radio-receiver module 4 and the battery module 3 and between the battery module 3 and the steering module 5. This flexibility between the functionality modules enables the toy car 1 to absorb static as well as dynamic impacts with a minimized risk of the rigid functionality modules being irreparably damaged.

Figure 2:
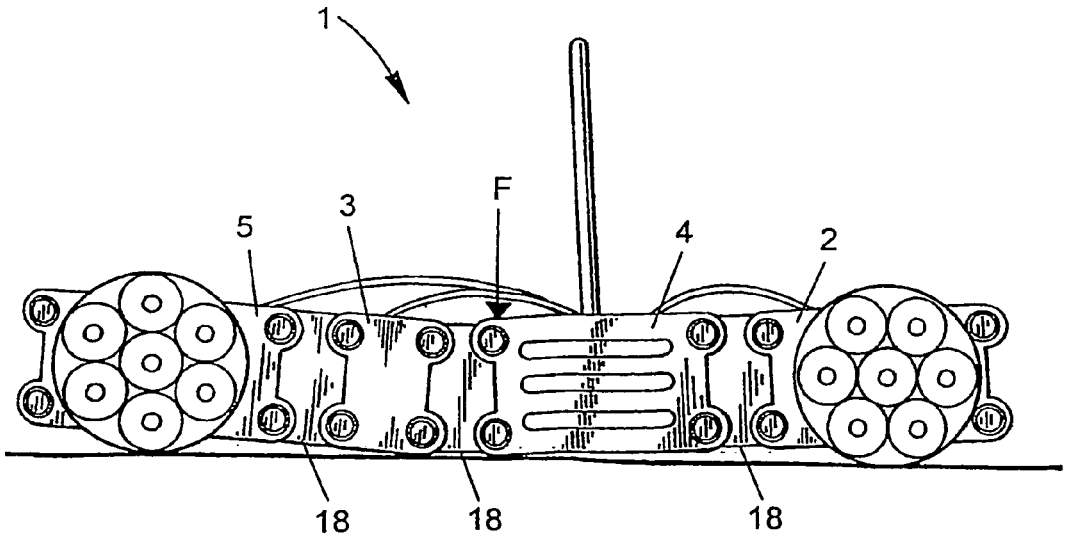
FIG. 2 shows the automotive toy shown in FIG. 1, seen from the side while exposed to an impact.

This is shown in further detail in FIG. 2 wherein the toy car 11 is depicted in a lateral view while under the influence of a vertical force F on the radio-receiver module 4 of the toy car 1. Such influence may occur, eg if a child steps on the toy car 1 or if an object is lost or topples down on the toy car 1. In a corresponding manner other impacts may be absorbed by the flexible toy building elements 18 of the toy car 1, eg if the toy car 1 bumps into an obstacle or hits ground following a jump.

Due to the flexible toy building elements 18 that couple the functionality modules to each other, the toy car 1 is particularly suitable for outdoors playing that is often characterised by being more rough than indoors playing. The flexible toy building elements 18 thus contribute considerably to the absorption of the dynamic forces that are generated when the toy car drives across an uneven surface, thereby protecting the functionality modules against excessive impacts.

As outlined in FIGS. 1 and 2, the interconnection between the functionality modules and the flexible toy building elements 18 consist in both the functionality modules and the flexible toy building elements 18 being provided with protruding elements having transversal openings in which a pin is mounted. This is shown in further detail in FIG. 3 that shows, in a partially sectional view, the interconnection between two functionality modules—the motor module 2 and the radio receiver module 4—via a flexible toy building element 18. The interconnection as such between the flexible toy building element 18 and the radio-receiver module 4 is shown in a sectional view, and it appears clearly that the radio-receiver module 4 is provided with protruding elements 19*a*,19*b*,19*c*, and that the flexible toy building element 18 is provided with second protruding elements 20*a*, 20*b* that are complementary with the protruding elements 19*a*,19*b*,19*c* of the radio-receiver module 4. All of the protruding elements 19*a*,19*b*,19*c*,20*a*,20*b* are provided with transversal openings, and it will appear that a pin 21 is mounted through these transversal openings for interconnecting the radio-receiver module 4 and the flexible toy building element 18.

The pin 21 is configured with a snap-engagement bead 22 that engages behind the opening in the protruding element 19*a* of the radio-receiver module 4, in which a couterboring is provided that makes room for the snap-engagement bead 22. The pin 21 is also provided with a slotting 23 in the region around the snap-engagement bead 22, whereby the pin 21 can be squeezed tightly in this particular area when the snap-engagement bead 22 passes through the transversal opening in the protruding part 19*a* of the radio-receiver module 4 when the pin 21 is mounted and dismounted. The pin 21 is also provided with a spherical grip 24 at the same end as the snap-engagement bead 22, which grip 24 can be used when the pin 21 is withdrawn from the protruding elements 19*a*,19*b*,19*c*,20*a*,20*b* of the radio-receiver module 4 and the flexible toy building element 18, respectively, upon separation of the elements. Of course, the grip 24 can be configured differently or optionally be eliminated altogether.

Figure 3:
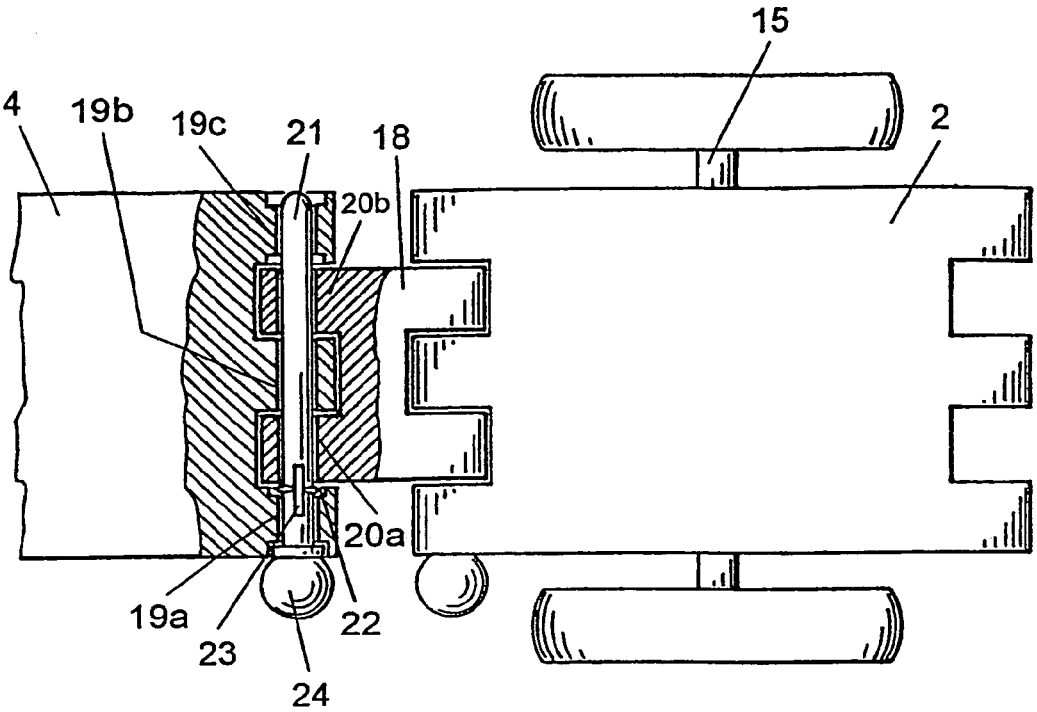
FIG. 3 is a partially sectional view of the interconnection between two functionality modules via a flexible toy building element.

As will appear from FIGS. 1 and 2 two pins 21 are used of the type shown in further detail in FIG. 3 for each interconnection between a flexible toy building element 18 and a functionality module. Hereby the interconnection is locked against rotation about one of the pins. Configuration of the coupling means on the functionality modules and the flexible toy building elements 18 *i* this manner yields a solid and strong interconnection that exhibits high resistance to unintentional-separation.

The flexible toy building elements 18 are preferably manufactured from a soft plastics material or rubber, and their flexibility thus lies in the material as such. By a flexing of the toy car 1 as shown in FIG. 2, the central portion of the flexible toy building elements 18 will stretch to a certain degree, but in addition to this the protruding elements 20*a*,20*b* will stretch comparatively more due to the smaller amount of material in these areas.

Figure 4:
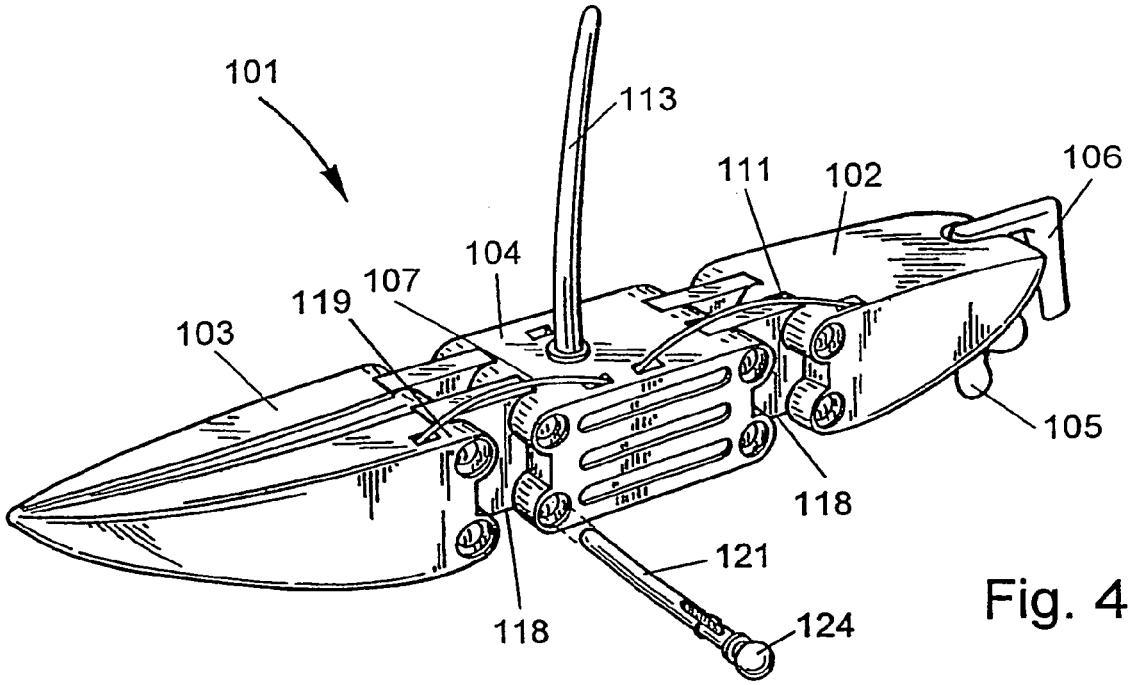
FIG. 4 shows an automotive toy according to the invention in an alternative embodiment.

FIG. 4 shows an automotive toy according to the invention in the form of a toy boat 101. This toy boat 101 is constructed from three functionality modules, viz a motor and steering module 102, a battery module 103 and a radio-receiver module 104 as well as two flexible toy building elements 118 that interconnect the radio-receiver module 104 with the motor and steering modules 102 and the battery module 103, respectively.

The battery module 103 is configured as a ship's stem and is provided with coupling means only at the one end in the form of protruding elements 119 with transversal openings in which pins 121 with spherical grips 124 are mounted in the same manner as shown in FIG. 3 concerning the toy car 1.

The radio-receiver module 104 is also provided with protruding parts for interconnection with the flexible toy building elements 118 in the same manner as the battery module 103. Besides, the radio-receiver module 104 is provided with an antenna 113 for receiving radio signals from a not shown remote controller that may be of any known type.

The motor and steering module 102 is provided with two electromotors (not shown) that are used partly for driving a propeller 105 and partly for rotating a wheel 106. The motor and steering module 102 is also provided with protruding elements for interconnection with a flexible toy building element 118.

Also in this case the radio receiver module 104 is supplied with power from the battery module via a cord 107, and a cord 111 connects the radio receiver module 104 to the motor and steering module 102 and provides it with power as well as signals for controlling the motors of the motor and steering module 102.

The presence of flexible toy building elements 118 means that the three functionality modules can flex relative to each other, eg by external impacts. Hereby the risk of damaging the toy boat 101 is reduced considerably, the static and dynamic forces by which it is influenced being to a very large extent absorbed by the flexible toy building elements 118 and causing merely a flexing of the functionality modules in relation to each other.

In the description of the invention reference is made to two embodiments: a toy car 1 and a toy boat 101. As mentioned above the automotive toy according to the invention may assume many other shapes, eg those of robots, motorcycles, aeroplanes, etc. The automotive toy has also been described as featuring preferred interconnecting means in the form of protruding elements having transversal openings through which pins are mounted when the toy building elements are interconnected. However, nothing prevents the interconnecting means from assuming other shapes that ensure stable and strong interconnection.

Additionally, the invention has been described with reference to remote-controlled automotive toys, but it also lends itself for use in connection with other types of toys that are constructed from toy building elements of which at least some are configured as functionality modules.

Finally, the flexible toy building elements are described as separate elements that are coupled by the user to the functionality elements during construction of the automotive vessel. According to a particular embodiment of the invention the functionality modules may, however, be solidly connected to one or more flexible toy building elements at the manufacturer's, which means that the functionality modules can be interconnected via the solidly mounted, flexible toy building element(s).

The invention claimed is:

1. An automotive toy comprising a number of toy building elements, from which at least two are configured as functionality modules each of which being configured with a means for performing a specific technical functionality in the automotive toy, and where one of said functionality modules is a motor module and one is a steering module, wherein at least one flexible toy building element made of a soft plastic or rubber material is provided, forming a flexible interconnection between the functionality modules, wherein the functionality modules are provided with protruding portions with transversal openings; and that the flexible toy building elements are provided with second protruding elements with transversal openings, which second protruding elements are complementary with the protruding elements on the functionality modules; and that the functionality modules and the flexible toy building elements are interconnected by means of pins that extend through the transversal openings in the protruding elements of both the functionality modules and the flexible toy building elements, said flexible toy building element being located between and connecting at least the motor module and the steering module.

2. An automotive toy according to claim 1, wherein the functionality modules further comprise a radio-signal receiver module; and that a remote controller with radio transmitter is provided.

3. An automotive toy according to claim 2, wherein the automotive toy is a toy car; and that the functionality modules further comprise a battery module.

4. An automotive toy comprising a number of toy building elements, from which at least three are configured as functionality modules each of which being configured with a means for performing a specific technical functionality in the automotive toy, and where said functionality modules comprise a combined motor and steering module, a battery module and a radio-signal receiver module wherein at least one flexible toy building element made of a soft plastic or rubber material is provided that is located between each functionality modules, forming a flexible interconnection between the functionality modules wherein the functionality modules are provided with protruding portions with transversal openings; and that the flexible toy building elements are provided with second protruding elements with transversal openings, which second protruding elements are complementary with the protruding elements on the functionality modules; and that the functionality modules and the flexible toy building elements are interconnected by means of pins that extend through the transversal openings in the protruding elements of both the functionality modules and the flexible toy building elements; and wherein the automotive toy is a toy boat.

5. An automotive toy according to claim 1, wherein the flexible toy building elements are provided between all the functionality modules.

6. An automotive toy comprising a number of toy building elements, from which at least two are configured as functionality modules each of which being configured with a means for performing a specific technical functionality in the automotive toy wherein at least one flexible toy building element is provided that is located between at least two functionality modules, such that this flexible toy building element forms a flexible interconnection between the functionality modules; wherein the functionality modules are provided with protruding portions with transversal openings; and that the flexible toy building elements are provided with second protruding elements with transversal openings, which second protruding elements are complementary with the protruding elements on the functionality modules; and that the functionality modules and the flexible toy building elements are interconnected by means of pins that extend through the transversal openings in the protruding elements of both the functionality modules and the flexible toy building elements.

7. An automotive toy according to claim 6, wherein each of the pins is provided with a snap-engagement bead; and the protruding elements on the functionality modules are configured with a counterboring at the transversal openings for receiving the snap-engagement bead of the pin.

8. An automotive toy according to claim 6, wherein each of the pins is provided with a grip at the one end.

9. An automotive toy comprising a number of toy building elements, from which at least two are configured as functionality modules each of which being configured with a means for performing a specific technical functionality in the automotive toy, and where one of said functionality modules is a motor module and one is a battery module, wherein at least one flexible toy building element made of a soft plastic or rubber material is provided, said flexible toy building element being located between and connecting at least the motor module and the battery module, forming a flexible interconnection between the functionality modules, wherein the functionality modules are provided with protruding portions with transversal openings; and that the flexible toy building elements are provided with second protruding elements with transversal openings, which second protruding elements are complementary with the protruding elements on the functionality modules; and that the functionality modules and the flexible toy building elements are interconnected by means of pins that extend through the transversal openings in the protruding elements of both the functionality modules and the flexible toy building elements, wherein the functionality modules and the flexible toy building elements are interconnected.

10. An automotive toy according to claim 9, wherein the functionality modules further comprise a radio-signal receiver module; and that a remote controller with radio transmitter is provided.

11. An automotive toy according to claim 9, wherein the flexible toy building elements are provided between all the functionality modules.

12. An automotive toy comprising a number of toy building elements, from which at least two are configured as functionality modules each of which being configured with a means for performing a specific technical functionality in the automotive toy, and where one of said functionality modules is a steering module and one is a battery module, wherein at least one flexible toy building element made of a soft plastic or rubber material is provided, said flexible toy building element being located between and connecting at least the steering module and the battery module, forming a flexible interconnection between the functionality modules, wherein the functionality modules are provided with protruding portions with transversal openings; and that the flexible toy building elements are provided with second protruding elements with transversal openings, which second protruding elements are complementary with the protruding elements on the functionality modules, and that the functionality modules and the flexible toy building elements are interconnected by means of pins that extend through the transversal openings in the protruding elements of both the functionality modules and the flexible toy building elements.

13. An automotive toy according to claim 12, wherein the functionality modules further comprise a radio-signal receiver module; and that a remote controller with a radio transmitter is provided.

14. An automotive toy according to claim 12, wherein the flexible toy building elements are provided between all the functionality modules.

* * * * *